United States Patent [19]

Koshizuka et al.

[11] Patent Number: 4,792,496

[45] Date of Patent: Dec. 20, 1988

[54] THERMAL TRANSFER RECORDING MEDIUM

[75] Inventors: Kunihiro Koshizuka; Shigehiro Kitamura; Takao Abe, all of Hino, Japan

[73] Assignee: Konishiroku Photo Industry Co., Ltd., Tokyo, Japan

[21] Appl. No.: 83,264

[22] Filed: Aug. 6, 1987

[30] Foreign Application Priority Data

Aug. 18, 1986 [JP] Japan ..... 51-192602

[51] Int. Cl.[4] ..... B41M 5/26

[52] U.S. Cl. ..... 428/522; 428/195; 428/211; 428/483; 428/484; 428/488.1; 428/514; 428/523; 428/913; 428/914

[58] Field of Search ..... 428/195, 484, 488.1, 428/488.4, 913, 914, 211, 483, 513, 514, 522, 523

[56] References Cited

U.S. PATENT DOCUMENTS 4,564,534 1/1986 Kushida et al. ..... 427/256
4,643,917 2/1987 Koshizuka et al. ..... 427/146
4,681,796 7/1987 Maehashi et al. ..... 428/218

FOREIGN PATENT DOCUMENTS 1098592 5/1986 Japan ..... 428/488.1

*Primary Examiner*—Ellis P. Robinson
*Assistant Examiner*—P. R. Schwartz
*Attorney, Agent, or Firm*—Frishauf, Holtz, Goodman & Woodward

[57] ABSTRACT

There is disclosed a thermal transfer recording medium having a colorant layer containing a heat-fusible substance and a colorant formed on a support, the colorant comprising a copolymer obtained from an α-olefin and an acrylic acid derivative represented by the formula (I):

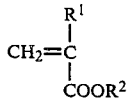

(I)

wherein $R^1$ represents a hydrogen atom or a methyl group and $R^2$ represents a straight or branched alkyl group having 1 to 8 carbon atoms, or vinyl acetate, with the content of the above acrylic acid derivative and vinyl acetate as a monomer unit being 10% or more and of a copolymer having a melt flow index of 8 to 40 G/10 min. and a polyoxyethylene type compound.

7 Claims, No Drawings

THERMAL TRANSFER RECORDING MEDIUM

BACKGROUND OF THE INVENTION

This invention relates to a thermal (heat-sensitive) transfer recording medium, more particularly to a thermal transfer recording medium capable of printing with high transfer sensitivity and with low energy, and also inhibiting generation of ground contamination (fog) on a recording sheet such as low smoothness paper and giving a dye transferred image with excellent fixability on a recording sheet and also high resolving power.

Thermal transfer recording medium has been used in the prior art as a recording medium for forming by transfer an image on a recording sheet such as plain paper by a thermal printer or a thermal facsimile.

Such a thermal transfer recording medium has at least one colorant layer on a support. As the colorant layer, there have been known layers containing colorants comprising dyes such as pigments and heat-fusible substances which are low melting substances such as waxes. Also, as the support, for obtaining good reproducibility of the dye transferred image obtained from the colorant layer coated thereon, films excellent in surface smoothness and dimensional stability have been used.

The thermal transfer recording medium of this kind in the prior art has been variously devised and proposed so as to effect transfer printed images sharply with good fixability onto the recording sheet with a smooth surface.

However, at the present time, it has been strongly demanded to have a thermal transfer recording medium which can also effect good transfer of printed images onto the so-called low smoothness surface which is not necessarily smooth on the surface.

For, in the case of performing, for example, a trial printing of a document by a thermal printer having a thermal head, it is not necessary at all to use an expensive smooth paper, but rather an inexpensive recording sheet with low smoothness may be desirably employed, and it is frequently practiced to use the back surface (this surface is usually a rough surface) of a plain paper of which a printed image is printed on the front surface, but has now become unnecessary. Also, for prevention of forgery of documents, or for presenting the specific feature of the addresser of the documents, it is sometimes necessary to transfer the printed images onto a recording sheet which has been intentionally made to have low smoothness surface. Besides, it is not only sufficient that printed images can be anyhow transferred onto low smoothness surface, but it has been increasingly required to form printed images onto a recording sheet of which surface is specially made rough with a thermal transfer recording medium with high transfer sensitivity, low energy, without generation of ground contamination (fog), and with good fixability and high resolving power.

In spite of such demands, various inventions and utility models concerning the ink layers in thermal transfer recording medium have been in most cases directed to plain papers with smooth surface, and it is not too much to say that substantially no thermal transfer recording medium has been proposed provided with an ink layer satisfying all of the increasing requirements as mentioned above.

SUMMARY OF THE INVENTION

An object of the present invention is to provide a thermal transfer recording medium capable of forming a printed image not only on a smooth surface but also on a surface with low smoothness with high transfer sensitivity and yet with low energy.

Another object of the present invention is to provide a thermal transfer recording medium capable of forming a printed image of high resolving power and high printing quality with good fixability not only on a smooth surface but also on a surface with low smoothness while further suppressing generation of fog.

Still another object of the present invention is to provide a thermal transfer recording medium capable of further alleviating the load given to the printer side of, for example, a wind-up torque.

As the result of intensive studies by the present inventors in order to accomplish the above objects, the present inventors have found that, in a thermal transfer recording medium having a colorant layer containing a heat-fusible substance and a coloring material on a support, by formulating a specific combination of a copolymer of specific compounds and a polyoxyethylene compound in the above colorant layer, the above objects can be accomplished, to reach the present invention.

More specifically, the gist of the present invention in order to accomplish the present invention is a thermal transfer recording medium having a colorant layer containing a heat-fusible substance and a colorant formed on a support, said colorant layer comprising a copolymer obtained from an α-olefin and an acrylic acid derivative represented by the formula (I):

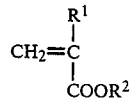

(I)

wherein $R^1$ represents a hydrogen atom or a methyl group and $R^2$ represents a straight or branched alkyl group having 1 to 8 carbon atoms, or vinyl acetate, with the content of the above acrylic acid derivative or vinyl acetate as a monomer unit being 10% or more and containing a copolymer having a melt flow index of 8 to 40 g/10 min. and a polyoxyethylene type compound.

DESCRIPTION OF THE PREFERRED EMBODIMENTS

Copolymer

The above copolymer is a copolymer which can be obtained from at least an α-olefin and an acrylic acid derivative represented by the following formula (I):

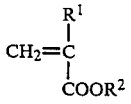

(I)

or vinyl acetate.

In the formula (I), $R^1$ represents a hydrogen atom or a methyl group. $R^2$ represents a straight or branched alkyl group having 1 to 8 carbon atoms, including, for example, a methyl group, an ethyl group, an n-propyl group, an isopropyl group, a butyl group, an isobutyl group, a t-butyl group, a pentyl group, a hexyl group, a heptyl group and an octyl group.

Among the above-mentioned acrylic acid derivatives having the above $R^1$ and $R^2$, preferred are, for example, a lower alkyl acrylate such as methyl acrylate, ethyl acrylate propyl acrylate, butyl acrylate, etc. and a lower alkyl methacrylate such as methyl methacrylate, ethyl methacrylate, propyl methacrylate, butyl methacrylate, etc.

The above α-olefin may include, for example, ethylene, propylene, butene-1, pentene-1, octene-1, etc. Preferred are ethylene and butene-1 and particularly preferred is ethylene.

Specific examples of such copolymers containing an acrylic acid derivative represented by the formula (I) or vinyl acetate and α-olefin as a monomer unit may include ethylene-ethyl acrylate copolymer, ethylene-propyl acrylate copolymer, ethylene-n-butyl acrylate copolymer, ethylene-iso-butyl acrylate copolymer, ethylene-pentyl acrylate copolymer, ethylene-hexyl acrylate copolymer, ethylene-octyl acrylate copolymer, and the like, and ethylene-methyl methacrylate copolymer, ethylene-ethyl methacrylate copolymer, ethylene-propyl methacrylate copolymer, ethylene-n-butyl methacrylate copolymer, ethylene-iso-butyl methacrylate copolymer, ethylene-pentyl methacrylate copolymer, ethylene-hexyl methacrylate copolymer, ethylene-octyl methacrylate copolymer, ethylene-vinyl acetate copolymer, propylene-vinyl acetate copolymer, butene-1-vinyl acetate copolymer, pentene-1-vinyl acetate copolymer and the like.

Such copolymers are not limited to the above binary copolymer and they may be ternary or more copolymer containing, for example, maleic anhydride, maleic acid, acrylamide, acrylonitrile, etc. as, for example, the third or fourth monomer unit.

Further, as to the preparative method, they may be copolymers obtained by mixing, for example, an α-olefin and an acrylic acid derivative or vinyl acetate with the third or fourth monomer, if necessary, followed by carrying out a polymerization reaction, or copolymers obtained by previously polymerizing an α-olefin and one kind of an acrylic acid derivative or vinyl acetate to prepare a polymer having a molecule weight with a certain degree, followed by copolymerizing this polymer with the remaining monomers.

Accordingly, since the preparative method is not limitative, the copolymer may be any of a block copolymer or a graft copolymer.

Further, such copolymers may be one kind or a mixture of copolymers with different bonding modes. In short, the copolymer may be a blend of, for example, ethylene-methyl acrylate copolymer and ethylene-vinyl acetate copolymer.

The preferred copolymer in accordance with the present invention is a copolymer of an α-olefin, particularly a copolymer of an ethylene and an acrylic acid derivative or vinyl acetate.

Next, the important point of the copolymer is that the content of the above acrylic acid derivative or vinyl acetate as a monomer unit in the copolymer is 10% or more, particularly preferably between 10 to 50% as well as the copolymer has a melt flow index (MI) of 8 to 40 g/10 min.

In case where the content of the above acrylic acid derivative or vinyl acetate as the monomer unit in the polymers is less than 10%, the ground contamination is remarkable when printing by thermal transfer recording medium is performed and the quality of printed letters is markedly lowered.

Further, the MI of the copolymer is out of the above-mentioned range, as in the cases mentioned for the content of the monomer unit, the ground contamination is remarkable and the quality of printed letters is markedly lowered.

As mentioned above, preferable copolymers may be obtained from at least an α-olefin and an acrylic acid derivative represented by the above formula (1) or vinyl acetate, with the content of the above acrylic acid derivative or vinyl acetate as a monomer unit being 10% or more and a melt flow index of the copolymer being 8 to 40 g/10 min. Of such copolymers, more preferable ones in the present invention have a Vicat softening point (according to ASTM D 1525) of 30° C. to 200° C., an elongation at break (according to JIS K 6301) of 200% or more and a strength at break (JIS K 6301) of 30 $kg/cm^2$ or more. It is preferable to select suitably from among the various copolymers as mentioned above, provided that they have such properties.

Polyoxyethylene Type Compound

Next, the above polyoxyethylene type compound is not particularly limited, provided that it is a compound having a moiety represented by the following formula (II) in the molecule:

$$-CH_2CH_2O)_n \quad \text{(II)}$$

in the formula (II), n is an integer of 2 or more, preferably an integer of 4 to 50.

However, the polyethylene type compound is more preferably one having both terminal ends in the form of derivatives rather than in the form of —OH. For example, derivatives of various bonding modes, typically ether bonds, ester bonds or other bonds with a sulfur atom or a nitrogen atom, urethane bonds, etc. formed by the reaction of one or two alcoholic hydroxyl groups of polyethylene glycol with various organic compounds may be included. The bonding form is not particularly essential in the present invention and therefore not particularly limited.

Adequate derivatization should be done based rather on molecular design with respect to molecular weight, miscibility with the heat-fusible substance and number of polar groups so as to achieve optimization for blocking performance, prevention of bleed-out, cohesive force and viscosity. A preferable derivatization may be ether derivatization. This is because a colorant layer containing an ether derivatized polyoxyethylene compound has generally excellent in blocking performance.

Anyway, polyoxyethylene type compounds which can be used in the present invention should be preferably substances which are in the state of solid state or semi-solid state with their melting points or softening points being 30° to 120 ° C., particularly 40° to 100° C.

Also, when the compound has a plural number of polyoxyethylene chains represented by the formula (II) in the molecule, the total of the molecular weights of the polyoxyethylene chain moieties represented by the above formula (II) may sometimes have a great influence on the effect of the present invention.

Preferable molecular weight of the polyoxyethylene chain moiety represented by the above formula (II) may depend on the molecular weight of the compound as a whole or the structure or the molecular weight of the portion other than the above polyoxyethylene moiety, but may be preferably, in most cases, 40 to 20000, particularly 40 to 2000.

Polyoxyethylene type compounds having such molecular weights can be exemplified by various compounds shown below.

(1) Mono- or diester derivatives of polyethylene glycol:

Those belonging to this category may include derivatives esterified with fatty acids having 8 to 50 carbon atoms, such as mono- or diglycolic esters of polyethylene glycol with (a) straight monoene acids, (b) polyene acids such as diene acid, triene acid and tetraene acid, (c) synthetic fatty acids and natural fatty acids, (d) secondary fatty acids and tertiary fatty acids, (e) straight fatty acids and branched fatty acids, (f) dimer acids, (g) polybasic acids such as dibasic acids and acid basic acids, (h) oxycarboxylic acids, (i) fatty acid chlorides, (j) fatty acid anhydrides, and (k) other compounds having single or a plural number of carboxyl groups in the molecule, etc.

Among them, preferred are fatty acids having about 8 to 30 carbon atoms such as caprylic acid, undecanoic acid, lauric acid, tridecanoic acid, myristic acid, pentadecanoic acid, palmitic acid, margaric acid, stearic acid, octacoic acid, merysic acid, etc, particularly mono- or diesters of polyethylene glycol ester with monocarboxylic acids such as nonadecanoic acic, arachic acid, heneicosanoic acid, behenic acid, brassidic acid, tricosaic acid, lignoceric acid, pentacosaic acid, etc.

Polyethylene glycol, as compared with polyethylene monoester, exhibits better dispersing characteristic in the colorant layer composition, and also has the excellent effect of not deteriorating dispersibility of the colorant, and is further excellent in the point that printed image with higher density can be transferred stably on a recording sheet having low surface smoothness. Accordingly, various polyethylene glycol diesters of fatty acids as mentioned above can be pointed out as preferable polyoxyethylene type compounds in the present invention.

In the case of a diester, the two polyoxyethylene chains bonde through ester linkages to the two carboxylic acids may have the molecular weights or structures, which may be either the same or different from each other.

Specific examples of the above diesters may include polyethylene glycol distearate [PEG 4000], polyethylene glycol dibehenate [PEG 14000], polyethylene glycol dipalmitate [PEG 600], polyethylene glycol dilaurate [PEG 100] and the like (all trade names). The numeral in the bracket indicates the average molecular weight of the polyoxyethylene chain.

(2) Alkyl, arylalkyl, alaryl or aryl monoethers of polyoxyethylene glycol (derivatives of polyoxyethylene glycol with one hydroxyl group being etherified):

Those belonging to this category may include, for example, alkyl, alaryl monoether derivatives with an ether residue having 6 or more carbon atoms, preferably 18 to 50 carbon atoms. The alkyl group and the alaryl group may be either straight or branched.

Specific examples may include polyethylene glycol mono-p-nonylphenyl ether, polyethylene glycol monobehenyl ether, polyethylene glycol monooleyl ether and the like.

Further, in the present invention, as a special case, the ether residue may be derived from unsaturated hydrocarbons, synthetic alcohols, oxycarboxylic acids, nitrogen-containing compounds and sulfur-containing compounds.

(3) Ether or ester derivatives of the monoether derivatives shown in the above (2):

That is, they are the above monoether derivatives of polyethylene glycol of which residual hydroxyl group is further derivatized into ether derivatives or ester derivatives.

In this case, ester derivatives may be obtained similarly as in the case of the above (1), and ether derivatives as in the case of the above (2).

Specific examples may include monobehenate of polyethylene glycol mono-p-nonylphenyl ether [PEG 800], monostearate of polyethylene glycol monostearyl ether [PEG 9000], polyethylene glycol dibehenyl ether [PEG 6000], polyethylene glycol monooleyl ether monobehenyl ether [PEG 4000] and the like (all trade names).

(4) Polyoxyethylene glycol ether derivatives of polyhydric alcohols:

As the above polyhydric alcohol, there may be included compounds having 2 or more alcoholic hydroxyl groups in the molecule such as glycerine, propylene glycol, pentaerythritol, polypropylene glycol, sorbitane (1,5-sorbitane, 1,4-sorbitane, 3,6-sorbitane, isosorbite, etc.), mannitol, and otherwise Povals (trade name) with molecular weights of 800 or less.

Further, the polyhydric alcohol may comprise two or more sets thereof bonded through another molecular chain such as polyoxyethylene chain, etc.

The polyoxyethylene glycol derivative as represented above has a polyoxyethylene glycol bonded through ether linkage to one hydroxyl group of said polyhydric alcohol, but it may also have the residual hydroxyl group of said polyhydric alcohol derivatized into ether according to the above (1) or (2) (this is a polyoxyethylene glycol diether derivative), or the residual hydroxyl group derivatized into ester.

Also, from a different point of view, the polyoxyethylene glycol ether derivative may also have a single or a plural number of polyoxyethylene chain in the molecule thereof. And, the hydroxyl group at the terminal end of the polyoxyethylene chain in the polyoxyethylene glycol ether derivative should desirably be derivatized into ester or ether according to the above (1) or (2).

Specific examples of the polyoxyethylene glycol ether derivatives as represented above are shown below:

polyoxyethylene monostearate of glycerine;
di(polyoxyethylenemonostearate) of glycerine;
polyoxyethylene monobehenate of sorbitane monobehenate;
polyoxyethylene ether of batyl alcohol;
polyoxyethylene monooleate of propylene glycol monooleate;
block copolymer of polypropylene glycol and polyoxyethylene glycol;
polyoxyethylene ether behenate of pentaerythritol distearyl ether;
polyoxyethylene ether of sorbitane ester;
polyoxyethylene ether of pentaerythritol;
polyoxyethylene ether of polyglycerine ester;
polyoxyethylene ether ester of batyl alcohol ester;
polyoxyethylene ether of mannitol ester.

(5) Polyoxyethylene derivatives of molecules having a sulfur atom or a nitrogen atom:

Specific examples belonging to this category may include alkylthiopolyoxyethylene, polyoxyethylene fatty acid amide, polyoxyethylene alkylamine, etc.

(6) Polyoxyethylene derivatives of polymers or copolymers:

Specific examples belonging to this category may include alkylaryl formaldehyde condensed polyoxyethylene ethers, polyoxyethylene ether esters of copolymers, polyoxyethylene ether derivatives of α-olefin-maleic anhydride copolymers, etc.

(7) Block polymers of synthetic polymers such as polyesters or polyurethanes with polyoxyethylene glycols.

(8) Compounds having anionic property:

Such compounds may include, for example, anionic surfactants containing polyoxyethylene such as polyoxyethylene alkyl ether carboxylates, polyoxyethylene aryl ether carboxylates, polyoxyethylene fatty acid ester sulfates, polyoxyethylene alkyl ether sulfates, polyoxyethylene aryl ether carboxylates, polyoxyethylene alkyl ether phosphates, polyoxyethylene aryl ether phosphates, polyoxyethylene alkylamide phosphates, polyoxyethylene arylamide phosphates, polyoxyethylene fatty acid ester carboxylates, etc.

(9) Compounds having cationic property:

Such compounds may include, for example, alkyl polyoxyethylene ether ammonium salts, aryl polyoxyethylene ether ammonium salts, polyoxyethylene hydroxyammonium salts, etc.

Having exemplified above various polyoxythylene compounds, such polyoxyethylene compounds are mixed with the above copolymer, the heat-fusible compound and the colorant in the present invention to prepare a colorant layer composition.

During preparation, the polyoxyethylene type compound, depending on its kind, may not be mixed under sufficiently dispersed state in the colorant layer composition. For example, when the polyoxyethylene chain has a large molecular weight of than 1000 or greater, miscibility of the polyoxyethylene compound with the above copolymer or with the heat-fusible substance as described below may be sometimes lowered.

However, for the reason which has not been necessarily clarified, the polyoxyethylene type compound can exhibit the effect of the present invention irrespectively whether it may be in a clearly dispersed state, a pseudo-mixed state or a mixed state.

Colorant Layer

The colorant layer in the present invention contains a colorant and a heat-fusible substance similarly as in the heat-sensitive transfer recording medium of the prior art, but its great specific feature resides in containing the above copolymer and the above polyoxyethylene type compound. Further, when a specific tacky resin is contained as the third component, the effect of the present invention can be highly exhibited.

Examples of the tacky resin as the above third component may include rosins such as gum rosin, tall rosin and wood rosin, etc.; modified rosins obtained by hydrogenation, disproportionation, dimerization, esterification, lime modification and combination thereof; terpene resins, hydrogenation modified terpenes and terpene phenol resins; natural resins such as danmal, coval and shellac; petroleum resins such as aliphatic, aromatic, copolymer type and alicyclic type and coumarone-indene resins; oil-soluble phenol resins such as alkylphenol resins, modified phenol resins, etc.; xylene type resins such as xylene resins and modified xylene resins, etc. Among them, natural resin types such as rosins, modified rosins, terpene resins, hydrogenation modified terpenes and petroleum resins such as C5 type and C9 type are preferred.

Further, among various resins as mentioned above, tacky resins having softening points ranging from 60° C. to 130° C. are preferred.

Heat-fusible Substance

As the above heat-fusible substance, for example, there may be employed the following materials: namely (1) ester wax (natural ester type wax such as carunauba wax, montan wax, etc., synthetic ester wax such as Hoechst Wax E, F, KP, KPS, BJ, OP, OM, X22, U and O produced by Hoechst K.K.); (2) oxidized wax (wax obtained by oxidation of paraffin wax, microcrystalline wax, etc., NPS-9210, NPS-6114 produced by Nippon Seiro K.K.; PETRONABA.C, CARDIS 314 produced by Toyo Petrolite K.K.; or Hoechst Wax S.L and LP produced by Hoechst K.K.); (3) low molecular weight polyethylene wax (particularly POLYWAX 500 or 655 produced by Toyo Petrolite K.K. having a molecular weight of 300 to 1000); (4) Paraffin wax (145, 150, 155, HNP-3, HNP-10, etc. produced by Nippon Seiro K.K.); (5) Microwax (Nisseki Microwax 155, 180, etc. produced by Nippon Sekiyu K.K., HI-MIC-1080, HI-MIC-2065, HI-MIC-2095, HI-MIC-1070, HI-MIC-1045, HI-MIC-2045, etc. produced by Nippon Seiro K.K.; STA WAX 100, BE SQU ARE 175, 185, VICTORY, ULTRAFLEX, etc. produced by Toyo Petrolite K.K., etc.) (all trade names); (6) otherwise higher fatty acids such as stearic acid, myristic acid, behenic acid, margaric acid, etc.; higher alcohols such as stearyl alcohol, behenyl alcohol, marganyl alcohol, myrisyl alcohol, eicosanol, etc.; higher fatty acid esters such as cetyl palmitate, myrisyl palmitate, cetyl stearate, myrisyl stearate, dodecyl stearate, etc.; vegetable waxes such as wood wax, auricuri wax, espal wax, etc.; animal waxes such as beeswax, insect wax, shellac wax, whale wax, etc.; stearon, sorbitane monostearate, polyoxyethylene monostearate, etc. In addition to these, olefin polymer waxes comprising copolymers of maleic anhydride with an α-olefin such as ethylene, propylene or butene-1 can be also suitably used.

The various heat-fusible substances as mentioned above can be used either alone as a single kind or as a combination of two or more kinds.

Among these various heat-fusible substaces, ester wax, praffin wax, olefin polymer wax are preferred, particularly carunauba wax, paraffin wax and polyethylene wax are preferred.

Colorant

The colorant to be contained in the colorant layer in the present invention can be used as suitably selected from the known dyes in the prior art, and may be suitably selected from among, for example, direct dyes, acidic dyes, basic dyes, disperse dyes, oil-soluble dyes, etc. As the dye to be used in the colorant of present invention, any dye which can be transferred (migrated) together with the heat-fusible substance can be used, and therefore pigments in addition to those mentioned above may be also available.

Specifically, examples of yellow dye may include Kayaron Polyester Light Yellow 5G-S (produced by Nippon Kayaku K.K.), Oil Yellow S-7 (terra abla), Eisenspiron GRH Special (produced by Hodogaya Kagaku K.K.), etc.; examples of red dye may include Diacerintone Fast Red R (produced by Mitsubishi Kasei K.K.), Dianix Brilliant Red BS-E (produced by Mitsubishi Kasei K.K.), Sumiplast Red FB (produced by Sumitomo Kagaku Kogyo K.K.), Sumiplast Red HGF (produced by Sumitomo Kagaku Kogyo K.K.), Kayaron Polyester Pink RCL-E (produced by Nihon Kayaku K.K.), Eisenspiron REd GEH Special (produced by Hodogaya Kagaku K.K.), etc.; examples of blue dye may include Diaceritone Fast Brilliant Blue R (produced by Mitsubishi Kasei K.K.), Dianix Blue EB-E (produced by Mitsubishi Kasei K.K.), Kayaron Polyester Blue B-SF Conc. (produced by Nihon Kayaku K.K.), Sumiplast Blue 3R (produced by Sumitomo Kagaku Kogyo K.K.), Sumiplast Blue G (produced by Sumitomo Kagaku Kogyo K.K.), etc. Also, as yellow pigment, for example, Hanza Yellow 3G (produced by Sumitomo Kagaku Kogyo K.K.), Taltrazine Lake, etc. may be employed; as red pigment, for example, Brilliant Carmine FB-Pure (produced by Sanyo Shikiso K.K.), Brilliant Carmine 6B (produced by Sanyo Shikiso K.K.), Alizarine Lake, etc. may be employed; as blue pigment, for example, Cerlean Blue, Sumika Print Cyanine Blue GN-O (produced by Sumitomo Kagaku Kogyo K.K.), Phthalocyanine Blue, etc. may be employed; and as black pigment, Carbon Black, Oil Black, etc. may be employed (all trade names).

Additive

In the colorant layer in the present invention, various additives in addition to the above components may be also formulated, provided that they do not interfere with the objects of the present invention.

As such additives, for example, vegetable oils such as castor oil, linseed oil, olive oil, etc., animal oils such as whale oils and mineral oils can be suitably used as the softening agent.

Formulation of Respective Components

The composition ratios of the above copolymer, the polyoxyethylene type compound, the heat-fusible substance, the colorant and, if necessary, the tacky resin as the third component for forming the colorant layer in the present invention is not limitative. In usual cases, the amount of the above copolymer formulated may be 5 to 40%, preferably 10 to 30% and the amount of the polyoxyethylene type copolymer formulated 0.5 to 20%, preferably 1 to 15%, based on the total amount of the colornnt layer. On the other hand, when a tacky resin which is the third component is formulated, its formulation ratio may be 0.3 to 24%, preferably 5 to 15% based on the total amount of the colorant layer. As to the heat-fusible substance, it may be 5 to 90 parts by weight (hereinafter "parts by weight" are abbreviated as "parts"), preferably 10 to 80 parts based on 100 parts by weight of the total amount of the colorant, and the above colorant may be 5 to 40 parts, preferably 10 to 20 parts.

Formulation of the above copolymer, the polyoxyethylene type compound, the heat-fusible substance, the colorant and, if necessary, the tacky resin which is the third component can be performed according to a method known in the art, for example, according to the method in which the above respective components are mixed at once.

For obtaining a colorant layer composition in which the respective components of the above copolymer, the above polyoxyethylene type compound, etc. are thoroughly mixed, the respective components as mentioned above may be preferably mixed by means of a dispersing machine such as dissolver, mixer, sand grinder, ball mill, etc. The dispersed particle size by means of these dispersing machines may be preferably made 10 μm or less.

The dispersed state can be easily examined by observation of the colorant composition from which the colorant is removed under the hot melt state or the coated state. By this observation, when formation of sea-island texture, white turbidity or liquid droplet (oil droplet) state, formation of phase separation is observed, it can be judged as unmixed state.

Support (Substrate)

The support as the substrate to be used in the heat-sensitive transfer recording medium according to the present invention should preferably have heat-resistant strength, dimentional stability and high surface smoothness. To add further, the support should desirably have heat-resistant strength to the extent that no softening or plasticization is effected by heating with a heating source such as thermal head, etc., and also provided with mechanical strength and dimensional stability as the support and also with sufficient smoothness for the colorant layer on the support to exhibit good transfer ratio.

As the above smoothness, it may be preferably 100 seconds or more as measured by smoothness test with a Bekk testing machine (JKS P 8119), and if it is 300 seconds or more, printed image with reproducibility can be obtained with better transfer ratio.

Examples of the material for support having preferable properties as mentioned above may include various papers such as plain paper, condenser paper, laminated paper, and coated paper, etc.; sheets or films of thermoplastic resins such as polyethylene, polypropylene, polyethylene terephthalate, polystyrene, polyimide, polyamide (Nylon, trade name), etc.; composites of the above papers with the above thermoplastic resin films or sheets; metal sheets such as metal foils of aluminum, etc., as preferable ones.

The thickness of the support may be generally about 60 μm or less for obtaining good thermal conductivity, particularly preferably 2 to 20 μm. The constitution of the back surface of the thermal transfer recording medium according to the present invention may have any desired constitution. Thus, the back surface of the support may be coated with a sticking layer, if necessary.

Formation of Colorant Layer onto Support

Since preferable techniques for formation of the colorant layer onto the surface of the above support are known in this field of art, the colorant layer can be formed on the surface of the support by use of such known techniques also for the thermal transfer recording medium according to the present invention.

For example, the colorant layer can be formed by hot melt coating of its composition, or alternatively by solvent coating of a coating liquid in which its composition is dispersed or dissolved in a suitable solvent. As the coating method, there may be employed, for example, the reverse roll coater method, the extrusion coater method, the gravure coater method, the wire bar coater method, or any other desired technique. The thickness of the colorant layer may be generally 15 μm, preferably 1 to 9 μm.

The thermal transfer recording medium thus obtained has a strength at break of 30 kg/cm$^2$ or higher, particularly 45 kg/cm$^2$ or higher, an elongation at break of 2% or longer, particularly 5% or longer, and can effect sharp printing thereon.

According to the present invention, since a special copolymer and a polyoxyethylene type compound are contained in the colorant layer in a thermal transfer recording medium having a colorant layer containing a heat-fusible substance and a colorant formed on the surface of a support, there can be provided a thermal transfer recording medium capable of: (1) transferring printed image of high resolving power with high transfer sensitivity and yet with low energy as well as good fixability, while suppressing further generation of fog, not only on a plain paper with smooth surface, as a matter of course, but also on a surface with low smoothness, and (2) lowering a wind-up torque to reduce the load applied to the printer side.

EXAMPLES

The present invention is described below by referring to the Examples, by which the present invention is not limited at all.

EXAMPLES 1 TO 6, COMPARATIVE EXAMPLES 1 to 13

A colorant layer composition having a composition comprising 15% carbon black, 4% polyethylene glycol monobehenyl ether (PEG, n=10) as the polyoxyethylene type compound, 40% paraffin wax (melting point: 68° C.), 11 % polyethylene wax (melting point: 64° C.), ethylene-vinyl acetate copolymer, of which formulatin amount is indicated in Table 1, having MI and CO (content of vinyl acetate or an acrylic acid derivative; % by weight, hereinafter the same will apply) shown in Table 1 and 15% Diacaruna 30 [produced by Mitsubishi Kasei K.K.] was applied on the surface of a polyethylene terephthalate film support with a thickness of 3.5 μm to a dried thickness of 5.0 μm to obtain a thermal transfer recording medium sample.

For the thermal transfer recording medium sample, printing of various Chinese characters was effected on a low smoothness paper with Bekk smoothnsss of 10 seconds by a thermal printer (trially made machine mounted with a thin film type line thermal head with a heat generating element density of 8 dots/mm) under printing pressures of 400 g/head and 600 g/head. And, contamination at the portions other than the printed portion was observed with a magnifier to evaluate the degree of ground contamination. And, contamination at the portions other than the printed portion was observed with a magnifier to evaluate the degree of the ground contamination. The results are shown in Table 1.

The symbols and the meaning thereof with respect to contamination in Table 1 are shown below:

O . . . no contamination at all.
Δ. . . slight contamination occurred.
X . . . marked contamination occurred.

For the thermal transfer recording media obtained in Examples 1 to 6 and Comparative Examples 6 to 9, by use of the above thermal printer, printing was effected in check pattern on a low smoothness paper under a printing pressure of 300 g/head, and its printing quality was observed and evaluated by observation with a magnifier. The results are shown in Table 2. The symbols in Table 2 indicate the evaluation contents as shown below:

O . . . edges of printing are sharp.
Δ . . . slight disintegration occurred at edges of printing.
X . . . defect and unfocussed portion occurred in printing.

With respect to Example 3, the wind-up states of the thermal transfer recording media obtained by using various wind-up torques were observed. The results are shown in Table 3. The symbols in Table 3 indicate the evaluation contents as shown below:

O . . . wind-up can be performed smoothly.
Δ . . . wind-up can be performed with a delay.
X . . . wind-up cannot be performed.

COMPARATIVE EXAMPLES 14 TO 23

Thermal transfer recording media were obtained by practicing the foregoing Examples 1 to 6 and Comparative examples 6 to 9 except that the formulation amount of the paraffin wax was changed from 40% to 44% and 4% polyethylene glycol monobehenyl ether was not added to formulate therein. For the thermal transfer recording media, printing was effected in check pattern on the above low smoothness paper by use of the above thermal printer under a printing pressure of 300 g/head, and its printing quality was evaluated by observation with a magnifier. The results are shown in Table 2.

The relationships between Examples and Comparative examples in which the kind and formulation amount of ethylene-vinyl acetate copolymer are the same, are shown below:

Comparative example 6—Comparative example 14
Example 1—Comparative example 14
Example 2—Comparative example 15
Example 3—Comparative example 16
Example 4—Comparative example 17
Comparative example 7—Comparative example 18
Comparative example 8—Comparative example 19
Example 5—Comparative example 20
Example 6—Comparative example 21
Example 7—Comparative example 22
Comparative example 9—Comparative example 23

COMPARATIVE EXAMPLE 24

Thermal transfer recording medium samples were prepared in the same manner as in Example 3 except that polyethylene glycol monobehenyl ether was not formulated therein.

For the thermal transfer recording medium, by use of the above thermal printer and various wind-up torques indicated in Table 3, the state of wind-up of the thermal transfer recording medium was observed. The results are shown in Table 3.

TABLE 1

| | Ethylene-vinyl acetate copolymer | | Printing pressure | |
|---|---|---|---|---|
| | MI | CO | 400 g/head | 600 g/head |
| Comparative example 1 | 2500 | 19 | X | X |
| Comparative example 2 | 1200 | 25 | X | X |
| Comparative example 3 | 500 | 27 | X | X |
| Comparative example 4 | 400 | 20 | X | X |
| Comparative example 5 | 150 | 20 | X | X |
| Comparative | 65 | 33 | X | X |

TABLE 1-continued

| | Ethylene-vinyl acetate copolymer | | Printing pressure | |
|---|---|---|---|---|
| | MI | CO | 400 g/head | 600 g/head |
| example 6 | | | | |
| Example 1 | 35 | 35 | O | O |
| Example 2 | 30 | 28 | O | O |
| Example 3 | 20 | 20 | O | O |
| Example 4 | 20 | 13 | O | O |
| Comparative example 7 | 20 | 6 | Δ | X |
| Comparative example 8 | 15 | 6 | Δ | X |
| Example 5 | 10 | 15 | O | O |
| Example 6 | 10 | 20 | O | O |
| Comparative example 9 | 10 | 6 | X | X |
| Comparative example 10 | 5 | 6 | X | X |
| Comparative example 11 | 2.5 | 18 | X | X |
| Comparative example 12 | 2 | 15 | X | X |
| Comparative example 13 | 1.3 | 10 | X | X |

TABLE 2

| | (A) | | (B) |
|---|---|---|---|
| Comparative example 6 | Δ | Comparative example 14 | Δ |
| Example 1 | O | Comparative example 15 | X |
| Example 2 | O | Comparative example 16 | X |
| Example 3 | O | Comparative example 17 | Δ |
| Example 4 | O | Comparative example 18 | X |
| Comparative example 7 | Δ | Comparative example 19 | X |
| Comparative example 8 | Δ | Comparative example 20 | Δ |
| Example 5 | O | Comparative example 21 | X |
| Example 6 | O | Comparative example 22 | X |
| Comparative example 9 | X | Comparative example 23 | Δ |

(A); Containing 4% polyoxyethylene glycol monobehenyl ether and 40% paraffin wax (B); Not containing polyoxyethylene glycol monobehenyl ether but containing 44% paraffin wax

TABLE 3

| Wind-up torque | Example 3 | Comparative example 24 |
|---|---|---|
| 20 g/cm | O | X |
| 30 g/cm | O | X |
| 40 g/cm | O | X |
| 60 g/cm | O | Δ |
| 80 g/cm | O | O |

EXAMPLES 7 AND 8, COMPARATIVE EXAMPLES 25 TO 31

A colorant layer composition having a composition comprising 15% carbon black, 10% polyethylene glycol distearate (Mw=400), 8% ester wax (melting point: 85° C.), 45% paraffin wax, 10% terpene resin and 12% ethylene-ethyl acrylate copolymer having MI and CO shown in Table 4 was applied onto the surface of a polyethylene terephthalate film support with a thickness of 3.5 μm to a dried film thickness of 5.0 μm to obtain a thermal transfer recording medium sample.

For the thermal transfer recording medium, by use of the similar printer as used in the above Example 1, printing of various Chinese characters was effected under a printing pressure of 400 g/head on a low smoothness paper with Beck smoothness of 10 seconds. And, the contamination at the portions other than the printed portions was observed with a magnifier to evaluate the degree of the ground contamination. The results are shown in Table 4.

TABLE 4

| | MI | CO | Ground contamination |
|---|---|---|---|
| Comparative example 25 | 20 | 4 | X |
| Comparative example 26 | 1500 | 23 | X |
| Comparative example 27 | 1100 | 28 | X |
| Comparative example 28 | 250 | 25 | X |
| Example 7 | 20 | 20 | O |
| Example 8 | 8 | 35 | O |
| Comparative example 29 | 6 | 22 | X |
| Comparative example 30 | 2.5 | 25 | X |
| Comparative example 31 | 1.5 | 25 | X |

As is apparent from Table 1 and Table 2, it can be understood that the thermal transfer recording medium samples according to the present invention all have no ground contamination also on low smoothness paper, can effect printing of high quality and the wind-up torque was light.

What is claimed is:

1. A thermal transfer recording medium having a colorant layer containing a heat-fusible substance, a colorant, a polyoxyethylene type compound and a copolymer compound formed on a support, said copolymer compound comprising a copolymer of an α-olefin and an acrylic acid derivative represented by the formula (I):

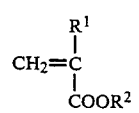

wherein $R^1$ represents a hydrogen atom or a methyl group and $R^2$ represents a straight or branched alkyl group having 1 to 8 carbon atoms, or vinyl acetate, with the content of the above acrylic acid derivative and vinyl acetate as a monomer unit being 10% or more and having a melt flow index of 8 to 40 G/10 min.

2. The thermal transfer recording medium according to claim 1, wherein said α-olefine is selected from the group consisting of ethylene, propylene, butene-1, pentene-1 and octene-1.

3. The thermal transfer recording medium according to claim 2, wherein said α-olefine is selected from the group consisting of ethylene and butene-1.

4. The thermal transfer recording medium according to claim 3, wherein said α-olefine is ethylene.

5. The thermal transfer recording medium according to claim 1, wherein said acrylic acid derivative is selected from the group consisting of a lower alkyl acrylate and a lower alkyl methacrylate each having 1 to 4 carbon atoms.

6. The thermal transfer recording medium according to claim 1, wherein the content of said acrylic acid derivative or vinyl acetate as a mononer unit is 10 to 50% by weight.

7. The thermal transfer recording medium according to claim 1, wherein said polyoxyethylene compound is a derivative of polyethylene glycol.

* * * * *